United States Patent [19]

Schmidt

[11] 4,309,044

[45] Jan. 5, 1982

[54] CROSS-COUNTRY SKI BINDING

[75] Inventor: Manfred Schmidt, Sindelfingen, Fed. Rep. of Germany

[73] Assignee: Vereinigte Baubeschlagfabriken Gretsch & Co., GmbH, Leonberg, Fed. Rep. of Germany

[21] Appl. No.: 961,930

[22] Filed: Nov. 20, 1978

[30] Foreign Application Priority Data

Dec. 3, 1977 [DE] Fed. Rep. of Germany ..... 2754005

[51] Int. Cl.[3] ..... A63C 9/10

[52] U.S. Cl. ..... 280/615

[58] Field of Search ..... 280/614, 615, 631, 632; 292/113, DIG. 49

[56] References Cited

U.S. PATENT DOCUMENTS

| | | | |
|---|---|---|---|
| 2,743,029 | 4/1956 | Mautner | 292/113 X |
| 3,386,748 | 6/1968 | Eie | 280/615 |
| 3,847,423 | 11/1974 | Gley | 292/113 |
| 4,032,172 | 6/1977 | Pyzel et al. | 280/615 |
| 4,082,312 | 4/1978 | Johnson | 280/615 |

FOREIGN PATENT DOCUMENTS

| | | | |
|---|---|---|---|
| 2380040 | 10/1978 | France | 280/615 |
| 105019 | 6/1924 | Switzerland | 280/615 |

*Primary Examiner*—Joseph F. Peters, Jr.
*Assistant Examiner*—Michael Mar
*Attorney, Agent, or Firm*—Craig and Antonelli

[57] ABSTRACT

A toggle lever type cross-country ski binding is provided which includes a retaining element pivotally attached to guide arms hingedly supported on a baseplate fixed to a ski. In operation, the retaining element is movable through a dead-center position between a lifted release position and a lowered in-use position with a hook-shaped projection engaging with a boot sole extension to hold the same against longitudinal movement. To facilitate resilient holding of the boot sole, without the need for additional tension springs in the toggle lever arrangement, various embodiments of the invention are disclosed including resilient longitudinal displaceability of the pivot joints between the guide members and the retaining element or between the retaining element and the sole extension.

21 Claims, 7 Drawing Figures

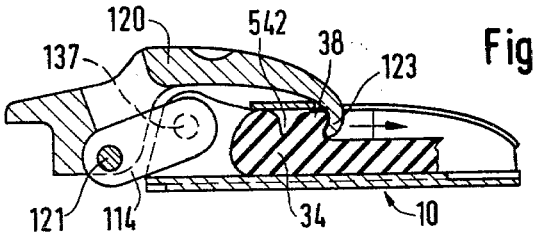
Fig. 5
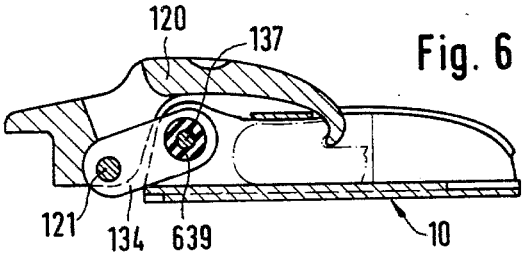
Fig. 6
Fig. 7
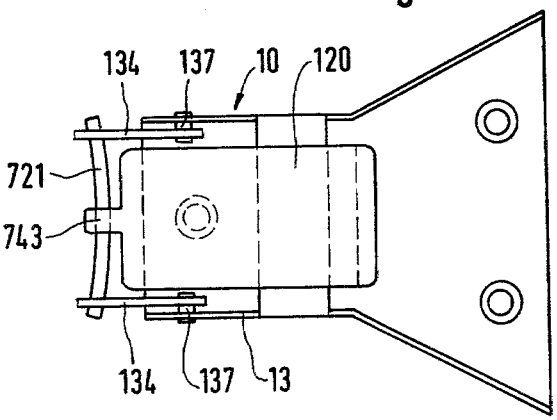

CROSS-COUNTRY SKI BINDING

BACKGROUND AND SUMMARY OF THE INVENTION

The invention relates to a cross-country ski binding of the type with a boot sole extended forwardly by way of a flexible zone and with a retaining element fixing the boot sole extension against longitudinal displacement in the in-use condition. Ski bindings of this type have been contemplated with a guide arm and/or a pair of such guide arms, forming together with the retaining element a toggle lever, this guide arm or these guide arms guiding the retaining element, which shifts forwardly due to pressure from above against the spring action of a tension spring, from a lifted release position into a lowered in-use position, wherein the retaining element secures the sole extension in place in the forward direction, by extending behind a projection or a corresponding part at the boot sole extension and by traversing a dead-center position with respect to the tension spring between the release position and the in-use position.

By using a guide arm or a pair of guide arms in such a binding, it is possible to attain a particularly reliable guidance and a forwardly pulling tightening of the retaining element. A tension spring, fashioned as a draw spring, secures the retaining element in its two rest positions on both sides of its dead-center position.

A primary object of the invention is to simplify a binding of the aforementioned type, particularly with respect to the spring system required for bracing the boot sole extension by means of the retaining element. The invention, accordingly, resides in the provision that one of the three joints of the toggle lever is resiliently supported or fashioned to be resilient in the longitudinal direction of the ski with respect to the latter and/or to the boot sole. This eliminates the need for a separate tension spring, which normally can be included in the binding arrangement in the form of a draw spring only under difficulties.

The resilient support or resilient construction of the respective joint can be effected in various ways according to the respective different preferred embodiments of the invention. In one embodiment of the invention, the guide arm has resilient play in the longitudinal direction with respect to the retaining element and/or with respect to the binding part fixedly attached to the ski. A spring can be supported, in this arrangement, preferably on a hinge pin connecting the retaining element to the guide arm, whereby the retaining element is urged forwardly in the longitudinal direction of the ski by the spring.

In another particularly simple embodiment of the invention, the guide arm proper is fashioned to be resilient in its longitudinal extension, and advantageously formed as a bracket.

In another embodiment of the invention, an abutment is provided for the spring, which spring is supported fixedly on the ski at its other end, the abutment being arranged on the ski or on a binding or bearing member affixed to the ski so that it is movable toward the rear in the longitudinal direction of the ski, the arrangement being such that the movable abutment, in the in-use position, contacts the boot sole extension under the action of the spring and presses the extension against a hook-shaped counter projection at the retaining element, this counter projection forming an effective third joint (pivot) of the toggle lever and extending behind a projection at the sole extension.

In another, especially simple embodiment of the invention, the projection at the sole extension, behind which the retaining element extends, is fashioned to be resilient, whereas the guide arm and the retaining element are fashioned to be rigid or essentially rigid or are supported against each other.

Other contemplated arrangements for producing a resilient effect securing the retaining element and thus the boot sole extension in position resides in constructing one of the joints of the guide arms to be resilient. For this purpose, it is contemplated, in particular, to embed the hinge pin of the resiliently fashioned joint in a cushion of an elastic material, such as rubber or the like. Also, the hinge pin of the resiliently fashioned joint is constructed to be flexurally elastic so that it bends resiliently under the effect of the tensile forces generated at the binding according to yet further contemplated embodiments.

The guide arms, forming a toggle lever together with the retaining element, as well as the springs can be arranged singly or in pairs, for example on both sides of the longitudinal axis of the binding or of the ski according to respective different contemplated preferred embodiments. In all of the preferred illustrated embodiments, a pair of guide arm toggle lever arrangements are provided at opposite sides of the ski binding longitudinal centerline with resultant reliable and stable holding of a ski boot toe extension. However, the mentioning of a guide means or some other part of the toggle lever or any other part associated therewith in the claims also contemplates inclusion of these parts in pairs, as well as on a single arrangement unless otherwise specifically set forth.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 5 is a schematic part sectional side view of a cross-country ski binding arrangement constructed in accordance with a fifth preferred embodiment of the invention;

FIG. 6 is a schematic part sectional side view of a cross-country ski binding arrangement constructed in accordance with a sixth preferred embodiment of the invention;

FIG. 7 is a top plan view of a cross-country ski binding arrangement constructed in accordance with a seventh preferred embodiment of the invention.

DETAILED DESCRIPTION OF THE DRAWINGS

Figure 1:
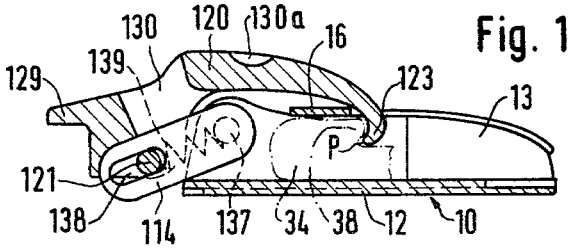
FIG. 1 is a schematic part sectional side view of a cross-country ski binding arrangement constructed in accordance with a first preferred embodiment of the invention.

A supporting or bearing member 10 is located on the side of the ski and is fixedly attached thereto and mounted to the ski (not shown) in a suitable way, for example by means of screws. This supporting or bearing member 10 has an essentially U-shaped cross section with a baseplate 12 forming the base of the "U" and sidewalls 13 forming the legs of the "U". The bearing member 10 extends rearwardly, suitably approximately into the toe zone of the boot to be affixed to the ski by the binding; the boot exhibiting a forward sole extension 34 with a projection 38 oriented upwardly toward the rear, this projection 38 cooperating with a retaining element 120 of the binding.

The retaining element 120 is, in all illustrated embodiments, articulated to a guide arm by means of a hinge pin 121; the guide arm, in turn, is pivotally supported about transverse ski axes by means of hinge pin 137 in the sidewalls 13 of the bearing member 10 affixed to the ski. In these arrangements, the retaining element 120 and the guide arm 114 constitute a toggle lever.

In each of the illustrated embodiments, the retaining element 120 comprises a rearward, hook-shaped locking member 123, a forward projection 129 serving as a handle, as well as recesses 130 and 130*a*. The recesses are intended, in particular, for receiving a tip of a ski pole to enable the skier to lift the retaining element 120 by means of the ski pole (recess 130) from the tightened in-use position (recess 130*a*), certain of these features of the retaining element have reference numerals inserted in only FIG. 1, so as not to obscure the other features illustrated in FIGS. 2 to 7.

In the following description the use of the singular terms "guide arm", "hinge pin", etc., relate to these structures at one side of the binding, it being understood that a second set of guide arms and associated hinge pins are provided at the other side of the binding.

According to the invention, an elastic play is provided in the articulated connection of the guide arm (or the guide arm pair) between the bearing member 10 affixed to the ski and the retaining element 120, ensuring an effective securing of the boot sole extension by means of the retaining element in the respectively illustrated in-use position, constituting a past-dead-center position. For this purpose, the guide arm 114, in the embodiment of FIG. 1, includes a slotted hole 138, into which the hinge pin 121 engages. A compression spring 139, supported with its rear end on the hinge pin 137 affixed to the ski, acts on the hinge pin 121, fixedly inserted in the retaining element 120, in that the spring tends to push the retaining element in the slotted hole 138 in the forward direction and thereby places the hook-shaped locking member 123 in point P in firm engagement with the projection 38 at the boot sole extension, thus displacing the latter in the bearing member 10 between the baseplate 12 and an upper guide member 16 of the bearing member, until the boot sole extension 34 finds a firm stop toward the front in the bearing member of the binding, for example on the sidewalls 13, which latter converge conically or taperingly toward the front. Thus, as noted above, three effective pivot joints exist, a first at the hook-shaped end of member 123, and second and third joints at pins 121, 137.

If the binding is to be opened, this can be done by manually lifting the retaining element 120 at the handle 129. Instead, it is also possible, as mentioned above, to accomplish the lifting action by means of the ski pole, by inserting the tip of the ski pole in the recess 130 and resting the tip therein a suitable way, whereupon by pivoting the ski pole the retaining element 120 can be lifted while it is supported on its hook-shaped locking member 123. During this procedure, the hinge pin 121 traverses a dead-centerline defined by the supporting point P of the locking member 123 on the projection 38, on the one hand, and by the hinge pin 137, on the other hand. After that, the retaining element 120 is additionally lifted by the spring 139 until the retaining element releases the boot sole extension 34, and the boot can be pulled out of the binding in the rearward direction. By beveling or rounding the projection 38 or the hook-shaped locking member 123, the release action can be enhanced. Optionally, the guide arm can be pivoted to any desired extent, for example up to 90° and more.

Figure 2:
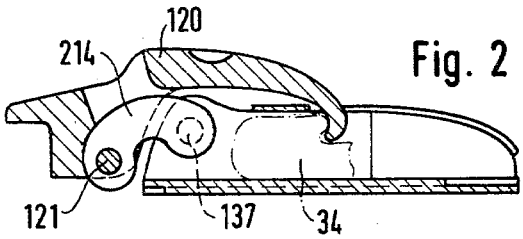
FIG. 2 is a schematic part sectional side view of a cross-country ski binding arrangement constructed in accordance with a second preferred embodiment of the invention.

The embodiment of FIG. 2 differs from that of FIG. 1 in that a resilient, bracket-shaped guide arm 214 (or pair of guide arms) is provided in place of the slotted hole 138 and the compression spring 139; this guide arm spreads resiliently when the retaining element 120 is lifted and the dead-center position is exceeded. Otherwise, the mode of operation of the arrangement according to FIG. 2 is the same as in FIG. 1.

Figure 3:
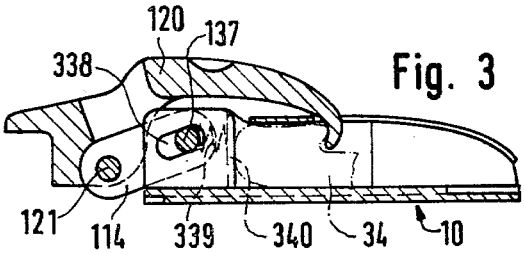
FIG. 3 is a schematic part sectional side view of a cross-country ski binding arrangement constructed in accordance with a third preferred embodiment of the invention.

In the embodiment of FIG. 3, the retaining element 120 is articulated without play to the guide arm 114 by means of the hinge pin 121. The guide arm 114, in turn, is displaceably mounted by means of a slotted hole 338 to the hinge pin 137 affixed to the ski, so that the arm can move in the longitudinal direction of the ski or in its own longitudinal direction. A compression spring 339 is interposed between a spring abutment 340 at the bearing member 10 affixed to the ski and the hinge pin 137 at the retaining element 120.

Figure 4:
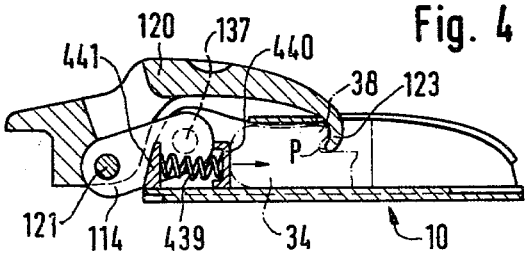
FIG. 4 is a schematic part sectional side view of a cross-country ski binding arrangement constructed in accordance with a fourth preferred embodiment of the invention.

In the embodiment of FIG. 4, the guide arm 114 is connected, on the one hand, by means of the hinge pin 121 with the retaining element 120 and, on the other hand, by means of the hinge pin 137 in the longitudinal direction of the ski without play to the bearing member 10 affixed to the ski. To produce a tightened past-dead-center position of the retaining element 120 in the in-use position of the binding, a compression spring 439 is provided which, with its rear end, rests on a spring abutment 440 displaceable on the ski-mounted bearing member 10 in the longitudinal direction of the ski and, with its front end, rests on a spring abutment 441 fixedly joined to the bearing member 10 mounted to the ski. The spring abutment 440 is firmly pressed by the compression spring 439 against the front end of the boot sole extension 34, which latter thereby braces, with its projection 38, the retaining element 120 in the illustrated past-dead-center position. Upon lifting of the retaining element, the boot sole 34 is pulled forwardly against the action of the compression spring 439, prior to attaining the dead-center position of the retaining element, determined by the straight line connecting the point of engagement of the hook-shaped locking member 123 at the projection 38 with the axis of articulation of the hinge pin or pins 137. After exceeding the dead-center position, the spring 439 can relax and thereby urge the boot sole outwardly toward the rear, during which step the locking member 123 is automatically lifted out of engagement with the projection 38 or is lifted by the skier, e.g. manually or by means of the ski pole.

A particularly simple embodiment is shown also in FIG. 5. In this instance, separate tension springs are avoided. The boot sole extension 34 has, instead, a projection 38 fashioned to be especially resilient due to indentations 542 or the like; the locking member 123 of the retaining element 120 is in engagement with this projection. The guide arm 114 is fashioned to be rigid as in the embodiment of FIG. 4 and is articulated in the longitudinal direction of the ski without play by means of the hinge pin 121 with the retaining element 120 and by means of the hinge pin 137 with the bearing member 10 mounted to the ski. When the retaining element 120 is tensioned from the release position into the in-use position, the boot sole extension 34 and/or the projection 38 thereof can be deformed elastically.

In the embodiment of FIG. 6, the resiliency in the connection of the retaining element 120 with the ski-mounted bearing member 10 is effected by a spring unit in the joint of the hinge pin 137, which is realized by a springy buffer 639, e.g. in the form of a rubber sleeve, inserted between the hinge pin 137 and the guide arm 134.

In the embodiment of FIG. 7, the spring action has been relocated in the joint of the forward hinge pin 721 (hinge pin 721 acts as a spring) which connects the guide arm or pair of guide arms 134 with the retaining element 120; this hinge pin 721 is supported at both of its ends in the guide arms 134 and penetrates with its central part a bearing boss 743 of the retaining element 120. At their rear ends, the guide arms 134 are again connected by means of hinge pins 137 to the sidewalls 13 of the ski-mounted bearing member.

Otherwise, the same disclosure applies to the embodiment of FIG. 7 as well as the preceding embodiments as has been set forth in connection with FIG. 1. Also, the invention is not limited to the illustrated embodiments; rather, particularly the spring action provided according to the invention between the retaining element and the boot sole extension can likewise be realized in some other way, according to yet further contemplated embodiments.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Cross-country ski binding comprising:

baseplate means fixedly attachable to a ski, retaining element means engageable with a ski boot sole extension at a first effective pivot joint to hold said sole extension against longitudinal displacement when said retaining element means is in an in-use skiing position, and guide arm means pivotally connected to said retaining element means at a second effective pivot joint and to said baseplate means at a third effective pivot joint such that said guide arm means and retaining element means together form a toggle lever with said retaining element means being movable through a dead-center position between a lifted release position and a lowered in-use position, wherein one of said effective second and third pivot joints is resiliently supported or configured in the longitudinal direction of the ski with respect to the other of said second and third pivot joints and the ski or boot sole extension, thereby assuring elastic force retention of said ski boot sole extension.

2. Cross-country ski binding according to claim 1, wherein the guide arm means itself is fashioned to be longitudinally resilient.

3. Cross-country ski binding according to claim 2, wherein the guide arm means is formed to be bracket-shaped.

4. Cross-country ski binding according to claim 1, wherein a spring is provided which is fixedly supported at one end on the baseplate means and at the other end on a longitudinally movable abutment, said abutment being engageable directly with a forward end of a boot sole extension to push the same in the rearward direction against a hook-shaped projection of the retaining element means which engages the boot sole extension at said first effective pivot joint.

5. Cross-country ski binding according to claim 1, further comprising a boot having a sole extension with a projection, wherein the retaining element means includes a hook-shaped projection engageable behind the projection at the sole extension, and wherein said projection at the sole extension is configured to be resiliently movable in the longitudinal direction.

6. Cross-country ski binding according to claim 5, wherein said projection at the sole extension includes recesses for lending longitudinal resiliency to said sole extension.

7. Cross-country ski binding according to claim 1, wherein one of the second and third effective joints is fashioned to be resilient.

8. Cross-country ski binding according to claim 7, wherein a hinge pin of the resiliently fashioned joint is embedded in a cushion of an elastic material, such as rubber or the like.

9. Cross-country ski binding according to claim 7, wherein a hinge pin of the resiliently fashioned joint is constructed to be flexurally elastic.

10. Cross-country ski binding comprising:

baseplate means fixedly attachable to a ski, retaining element means engageble with a ski boot sole extension at a first effective pivot joint to hold said sole extension against longitudinal displacement when said retaining element means is in an in-use skiing position, and guide arm means pivotally connected to said retaining element means at a second effective pivot joint and to said baseplate means at a third effective pivot joint such that said guide arm means and retaining element means together form a toggle lever with said retaining element means being movable through a dead-center position between a lifted release position and a lowered in-use position, wherein the guide arm means exhibits a play in the longitudinal direction of the ski with respect to one of the retaining element means and the baseplate means, and wherein a spring acts on one of a hinge pin connecting the guide arm means with the retaining element means and a hinge pin connecting the guide arm means with the baseplate means to resiliently press the retaining element means forwardly in the longitudinal direction of the ski thereby assuring elastic force retention of said ski boot sole extension.

11. Cross-country ski binding according to claim 1 or 10, wherein the guide arm means includes a pair of guide arm members, one on each side of the baseplate means.

12. Cross-country ski binding according to claim 1 or 10, wherein the retaining element means is configured as a single member having a downwardly projecting hook-shaped projection engageable with a corresponding projection at a boot sole extension.

13. Cross-country ski binding according to claim 12, wherein said retaining element means includes forwardly facing handle means for accommodating manual lifting and lowering of same.

14. Cross-country ski binding according to claim 13, wherein said retaining means includes an opening for engagement by a ski pole to lift and lower the same.

15. Cross-country ski binding according to claim 2, wherein said longitudinal play is achieved by a lost motion coupling means comprising one of said hinge pins.

16. Cross-country ski binding according to claim 15, wherein said lost motion coupling means further comprises an elongated slot means formed in said guide arm means and within which said one of the hinge pins is received.

17. Cross-country ski binding according to claim 16, wherein said one of the hinge pins is the hinge pin connecting the guide arm means with the retaining element means.

18. In a cross-country ski binding of the type comprising a baseplate member that is fixedly attachable to a ski, a retaining member that is configured for retainably engaging a forward sole extension of a ski boot, and a pivot link interconnection between said baseplate member and said retaining member, the improvement wherein said pivot link interconnection is constructed of rigid elements and a resilient element interconnected together so as to experience a resilient play for producing a securement between said retaining member and a forward sole extension that, in use of the ski binding, is resilient in a longitudinal direction relative to the extension secured due to resiliency of said pivot link interconnection in said longitudinal direction created by said resilient play.

19. In a cross country ski binding of the type comprising a baseplate member that is fixedly attachable to a ski, a retaining member that is configured for retainably engaging a forward sole extension of a ski boot, and a pivot link interconnection between said baseplate member and said retaining member, the improvement wherein said interconnection is constructed to enable longitudinal movements for producing a securement between said retaining member and a forward sole extension that in an in-use position of the ski binding, is resilient in a longitudinal direction relative to the extension secured, and wherein said construction of the interconnection enabling longitudinal movements comprises guide arm means, a first hinge pin for connecting said guide means to said base plate member, a second hinge pin for connecting said guide arm means to said retaining member, said hinge pins being mounted for enabling relative displacement therebetween, and spring means for applying a biasing force acting to control said relative displacement.

20. In a cross country ski binding according to claim 19, wherein said second hinge pin is received within elongated slot means formed in said guide arm means, and said spring means acts upon said second hinge pin to control movement thereof within said elongated slot means.

21. In a cross country ski binding according to claim 18 or 19, wherein said pivotal interconnection is constructed to pass through a dead-center position, relative an area of engagement of the retaining member with a forward sole extension, during movement of the retaining member between released and in-use positions.

* * * * *